US011173622B2

(12) United States Patent
Barber et al.

(10) Patent No.: US 11,173,622 B2
(45) Date of Patent: Nov. 16, 2021

(54) APPARATUS AND METHOD FOR ADJUSTING THE CUTTING THICKNESS OF A FOOD CUTTING APPARATUS

(71) Applicant: Frito-Lay North America, Inc., Plano, TX (US)

(72) Inventors: Keith A. Barber, Plano, TX (US); Richard J. Ruegg, Frisco, TX (US)

(73) Assignee: Frito-Lay North America, Inc., Plano, TX (US)

( * ) Notice: Subject to any disclaimer, the term of this patent is extended or adjusted under 35 U.S.C. 154(b) by 213 days.

(21) Appl. No.: 16/736,037

(22) Filed: Jan. 7, 2020

(65) Prior Publication Data

US 2020/0215711 A1 Jul. 9, 2020

Related U.S. Application Data

(60) Provisional application No. 62/790,351, filed on Jan. 9, 2019.

(51) Int. Cl.

| | |
|---|---|
| ***B26D 7/26*** | (2006.01) |
| ***B26D 1/03*** | (2006.01) |
| ***B26D 7/06*** | (2006.01) |

(52) U.S. Cl.

CPC ..... *B26D 7/2628* (2013.01); *B26D 1/03* (2013.01); *B26D 7/0691* (2013.01); *B26D 7/2614* (2013.01); *B26D 2210/02* (2013.01)

(58) Field of Classification Search

CPC ..... B26D 7/2628; B26D 1/03; B26D 7/0691; B26D 7/2614

See application file for complete search history.

(56) References Cited

U.S. PATENT DOCUMENTS

| | | | | |
|---|---|---|---|---|
| 3,139,128 | A | 6/1964 | Urschel et al. | |
| 3,395,742 | A * | 8/1968 | Sanders | B26D 1/0006 83/698.41 |
| 4,604,925 | A | 8/1986 | Wisdom | |
| 5,163,563 | A * | 11/1992 | Coppolani | B07B 1/185 209/288 |

(Continued)

FOREIGN PATENT DOCUMENTS

| | | |
|---|---|---|
| EP | 0495239 | 7/1992 |
| EP | 1918078 | 5/2008 |

(Continued)

OTHER PUBLICATIONS

International Search Report and Written Opinion of PCT/US2020/012465 dated Apr. 28, 2020.

(Continued)

*Primary Examiner* — Sean M Michalski

(74) *Attorney, Agent, or Firm* — Barnes & Thornburg LLP; G. Peter Nichols

(57) ABSTRACT

An apparatus for cutting food products is disclosed. The apparatus includes a cutting head comprising a cutting tool that is rotatable between a plurality of positions to change the cutting thickness of the cutting tool. The cutting head also includes a biasing element that biases the cutting tool in a position, and a moveable stop configured to cooperate with the biasing element to maintain the first cutting tool at any of the plurality of positions. The biasing element may be a mechanical spring.

37 Claims, 10 Drawing Sheets

(56) References Cited

U.S. PATENT DOCUMENTS

| | | | | |
|---|---|---|---|---|
| 5,555,787 | A * | 9/1996 | Barber | B23D 35/008 83/403 |
| 5,694,824 | A * | 12/1997 | Jacko | B26D 1/03 83/403 |
| 6,968,765 | B2 | 11/2005 | King | |
| 7,658,133 | B2 * | 2/2010 | Jacko | B26D 7/0691 83/403 |
| 8,161,856 | B2 * | 4/2012 | Jacko | B26D 1/03 83/403 |
| 9,193,086 | B2 | 11/2015 | Jacko et al. | |
| 9,469,041 | B2 * | 10/2016 | King | B26D 3/26 |
| 11,027,450 | B2 * | 6/2021 | Gereg | B26D 7/0691 |
| 2004/0079213 | A1 * | 4/2004 | Jensen | B26D 1/03 83/418 |
| 2004/0237747 | A1 * | 12/2004 | King | B26D 7/0691 83/663 |
| 2014/0007751 | A1 | 1/2014 | Michel et al. | |
| 2014/0230621 | A1 | 8/2014 | Bucks | |
| 2014/0290451 | A1 * | 10/2014 | Jacko | B26D 7/2614 83/13 |
| 2015/0140198 | A1 * | 5/2015 | Rawlings | B26D 1/0006 426/637 |
| 2016/0361831 | A1 | 12/2016 | Fant | |
| 2017/0225348 | A1 * | 8/2017 | Jacko | B26D 1/03 |
| 2018/0126581 | A1 | 5/2018 | Jacko | |
| 2018/0229390 | A1 * | 8/2018 | Gereg | B26D 1/36 |
| 2018/0333886 | A1 * | 11/2018 | Gereg | B26D 7/0691 |
| 2019/0329437 | A1 * | 10/2019 | Gereg | B26D 7/2614 |
| 2020/0215711 | A1 * | 7/2020 | Barber | B26D 3/26 |

FOREIGN PATENT DOCUMENTS

| | | |
|---|---|---|
| EP | 3412418 | 12/2018 |
| JP | 2017-108702 | 6/2017 |

OTHER PUBLICATIONS

International Search Report and Written Opinion, Application No. PCT/US2020/012553 dated Mar. 30, 2020.

* cited by examiner

APPARATUS AND METHOD FOR ADJUSTING THE CUTTING THICKNESS OF A FOOD CUTTING APPARATUS

This application claims priority to U.S. Provisional Application No. 62/790,351, filed on Jan. 9, 2019, which is incorporated herein in its entirety.

TECHNICAL FIELD

The present disclosure relates generally to method and equipment for cutting food products.

BACKGROUND

Various types of equipment are known for cutting food products, such as vegetable, fruit, dairy, and meat products. This equipment may slice, shred, or otherwise prepare the food products for further processing. One type of slicing equipment is commercially available from Urschel Laboratories, Inc., under the name Urschel Model CC® machine line, which includes centrifugal-type slicers capable of uniformly slicing food products.

SUMMARY

According to one aspect of the disclosure, an apparatus for cutting food products is disclosed. The apparatus includes a cutting head comprising a cutting tool that is rotatable between a plurality of positions to change the cutting thickness of the cutting tool. The cutting head also includes a biasing element such as, for example, a mechanical spring, and a moveable stop configured to cooperate with the biasing element to maintain the first cutting tool at any of the plurality of positions. In some embodiments, the apparatus may include an adjustment mechanism that is operable to move the cutting tool before or during a cutting operation. In some embodiments, the cutting head may include a plurality of cutting tools, and each cutting tool may be rotatable between a plurality of positions to change the cutting thickness of each cutting tool. Additionally, in some embodiments, the apparatus may include an adjustment mechanism that is operable to move all of the cutting tools before or during a cutting operation.

According to another aspect of the disclosure, an apparatus for cutting food products comprises a cutting head that comprises a plurality of cutting tools arranged around a central axis. Each cutting tool includes a cutting blade positioned at a first end and a trailing surface positioned at a second end opposite the first end. The trailing surface of a first cutting tool of the plurality of cutting tools cooperates with the cutting blade of a second cutting tool of the plurality of cutting tools to define a cutting gap. The first cutting tool is rotatable between a first position in which the cutting gap is a first cutting thickness and a second position in which the cutting gap is a second cutting thickness that is different from the first cutting thickness. The cutting head includes a biasing element that biases the first cutting tool toward the first position. The cutting head includes an adjustment mechanism operable to rotate the first cutting tool between the first position and the second position.

In some embodiments, the second cutting thickness may be less than the first cutting thickness such that the cutting head is configured to produce slices of the food products that are thinner when the first cutting tool is positioned at the second position than when the first cutting tool is positioned at the first position.

In some embodiments, the trailing surface of the first cutting tool may be located a first radial distance from the central axis when the first cutting tool is positioned at the first position and a second radial distance from the central axis when the first cutting tool is positioned at the second position. The second radial distance may be different the first radial distance. In some embodiments, the first radial distance is less than the second radial distance.

In some embodiments, the apparatus may further comprise an annular ring extending around the central axis. The biasing element may be a spring having a first end that engages the annular ring and a second end that engages the second end of the first cutting tool. The spring may be an elastic strap extending between the annular ring and the first cutting tool.

In some embodiments, the apparatus may further comprise an annular ring extending around the central axis. Each cutting tool of the plurality of cutting tools may be rotateably coupled to the annular ring. The first cutting tool further may include a base extending from the first end of the first cutting tool to the second end of the first cutting tool. The base may be rotateably coupled to the annular ring at a first joint that is located on an imaginary radial line extending from the central axis. The cutting blade of the first cutting tool may include a leading edge that is located on the imaginary radial line. The leading edge of the cutting blade may be spaced radially inward from the first joint. The first joint may include an integral hinge that connects the base to the annular ring.

In some embodiments, the adjustment mechanism may include a cam that is rotatable about a cam axis between a first rotation position in which the first cutting tool is located at the first position and a second rotation position in which the first cutting tool is located at the second position. The cam may engage the second end of the first cutting tool. The cam may include a curved, oblong outer wall that engages the first cutting tool. In some embodiments, the curved, oblong outer surface may include a semi-circular section and a semi-elliptical section.

In some embodiments, the adjustment mechanism may further include a first body coupled to the cam and a second body coupled to the first body. The first body may be configured to rotate and may have a first plurality of gear teeth. The second body may be configured to rotate and may have a second plurality of gear teeth interdigitated with the first plurality of gear teeth. Rotation of the second body may cause rotation of the first body and rotation of the cam between the first rotation position and the second rotation position. The second body may be configured to rotate about a rotation axis that extends parallel to the central axis. The second body may be configured to rotate about a rotation axis that extends coincident with the central axis.

In some embodiments, the cam may be engaged with each of the plurality of cutting tools. Each cam may be rotatable about a cam axis to cause the rotation of a corresponding cutting tool of the plurality of cutting tools. A first body may be coupled to each cam and the second body. The rotation of the second body may cause rotation of each first body and rotation of each cam to cause the rotation of each cutting tool of the plurality of cutting tools. The cam axis may extend parallel to the central axis.

In some embodiments, the apparatus may further comprise a plate operable to rotate about the central axis. The cutting head may be positioned at an outer periphery of the plate and may cooperate with the plate to define a chamber sized to receive one or more food products.

In some embodiments, each of the plurality of cutting tools may be operable to rotate relative to the other cutting tools. The adjustment mechanism may include an annular body rotateably coupled to the plurality of cutting tools, and rotation of the annular body may cause rotation of each of the plurality of cutting tools. The adjustment mechanism may include a moveable stop coupled to the first cutting tool.

According to another aspect of the disclosure, an apparatus for cutting food products is disclosed. The apparatus comprises a cutting head that comprises a plurality of cutting tools arranged around a central axis. Each cutting tool includes a cutting blade positioned at a first end and a trailing surface positioned at a second end opposite the first end. The trailing surface of a first cutting tool of the plurality of cutting tools cooperates with the cutting blade of a second cutting tool of the plurality of cutting tools to define a cutting gap. The trailing surface of the first cutting tool is rotatable between a first position in which the cutting gap is a first cutting thickness and a second position in which the cutting gap is a second cutting thickness that is different from the first cutting thickness. The cutting head includes a biasing element that biases the first cutting tool toward the first position. The cutting head includes an adjustment mechanism coupled to the first cutting tool. The adjustment mechanism includes a moveable stop operable to rotate the first cutting tool between the first position and the second position.

In some embodiments, the moveable stop may engage the second end of the first cutting tool. Additionally, in some embodiments, the moveable stop may include a curved, oblong outer surface that engages the first cutting tool. In some embodiments, the apparatus may include an outer ring, and the curved, oblong outer surface may engage the outer ring.

In some embodiments, the adjustment mechanism may further include a first body coupled to the moveable stop and a second body coupled to the first body. The first body may be configured to rotate and may have a first plurality of gear teeth. The second body may be configured to rotate and may have a second plurality of gear teeth interdigitated with the first plurality of gear teeth. The rotation of the second body may cause rotation of the first body to operate the moveable stop to rotate the first cutting tool between the first position and the second position.

In some embodiments, the moveable stop is one of a plurality of moveable stops. Each moveable stop may be operable to cause the rotation of a corresponding cutting tool of the plurality of cutting tools. The first body may be one of a plurality of first bodies. Each first body may be coupled to a corresponding moveable stop and the second body. The rotation of the second body may cause rotation of each first body to operate the moveable stops to cause the rotation of the plurality of cutting tools.

According to another aspect, an apparatus for cutting food products is disclosed. The apparatus comprises a cutting head that comprises a plurality of cutting tools arranged around a central axis. Each cutting tool includes a cutting blade positioned at a first end and a second end positioned opposite the first end. The second end of each cutting tool cooperates with the cutting blade of an adjacent cutting tool to define a cutting gap. Each cutting tool is rotatable between a first position in which the cutting gap is a first cutting thickness and a second position in which the cutting gap is a second cutting thickness that is different from the first cutting thickness. The cutting head includes an adjustment mechanism operable to rotate multiple cutting tools of the plurality of cutting tools between the first position and the second position.

In some embodiments, the cutting head may include a plurality of biasing elements. Each biasing element may be configured to bias a corresponding cutting tool in the first position. The plurality of biasing elements may include an elastic strap. The plurality of biasing elements may include an integral hinge.

In some embodiments, the adjustment mechanism may be operable to rotate all of the cutting tools of the plurality of cutting tools together. The adjustment mechanism may include a plurality of moveable stops, a plurality of first bodies, and a second body coupled to the plurality of first bodies. Each moveable stop may be operable to cause the rotation of a corresponding cutting tool of the plurality of cutting tools. Each first body may have a first plurality of gear teeth and may be coupled to a corresponding moveable stop to rotate with the corresponding moveable stops. The second body may be configured to rotate and may have a second plurality of gear teeth interdigitated with the first plurality of gear teeth of each first body. Rotation of the second body may cause rotation of the first body to operate the moveable stops to rotate the cutting tools between their respective first position and second position. The plurality of moveable stops may include a plurality of cams.

In some embodiments, the apparatus may further comprise a plurality of biasing elements. Each biasing element may be configured to bias a corresponding cutting tool in the first position.

According to another aspect, an apparatus for cutting food products is disclosed. The apparatus comprises a cutting head that comprises a plurality of cutting tools arranged around a central axis. Each cutting tool includes a cutting blade positioned at a first end and a trailing surface positioned at a second end opposite the first end. The trailing surface of a first cutting tool of the plurality of cutting tools cooperates with the cutting blade of a second cutting tool of the plurality of cutting tools to define a cutting gap. The trailing surface of the first cutting tool is rotatable between a plurality of positions. The plurality of positions includes a first position in which the cutting gap is a first cutting thickness and a second position in which the cutting gap is a second cutting thickness that is different from the first cutting thickness. The cutting head includes a biasing element that biases the first cutting tool in the first position. The cutting head includes a moveable stop configured to cooperate with the biasing element to maintain the first cutting tool at any of the plurality of positions.

BRIEF DESCRIPTION OF THE DRAWINGS

The detailed description particularly refers to the following figures, in which.

DETAILED DESCRIPTION

Figure 1:
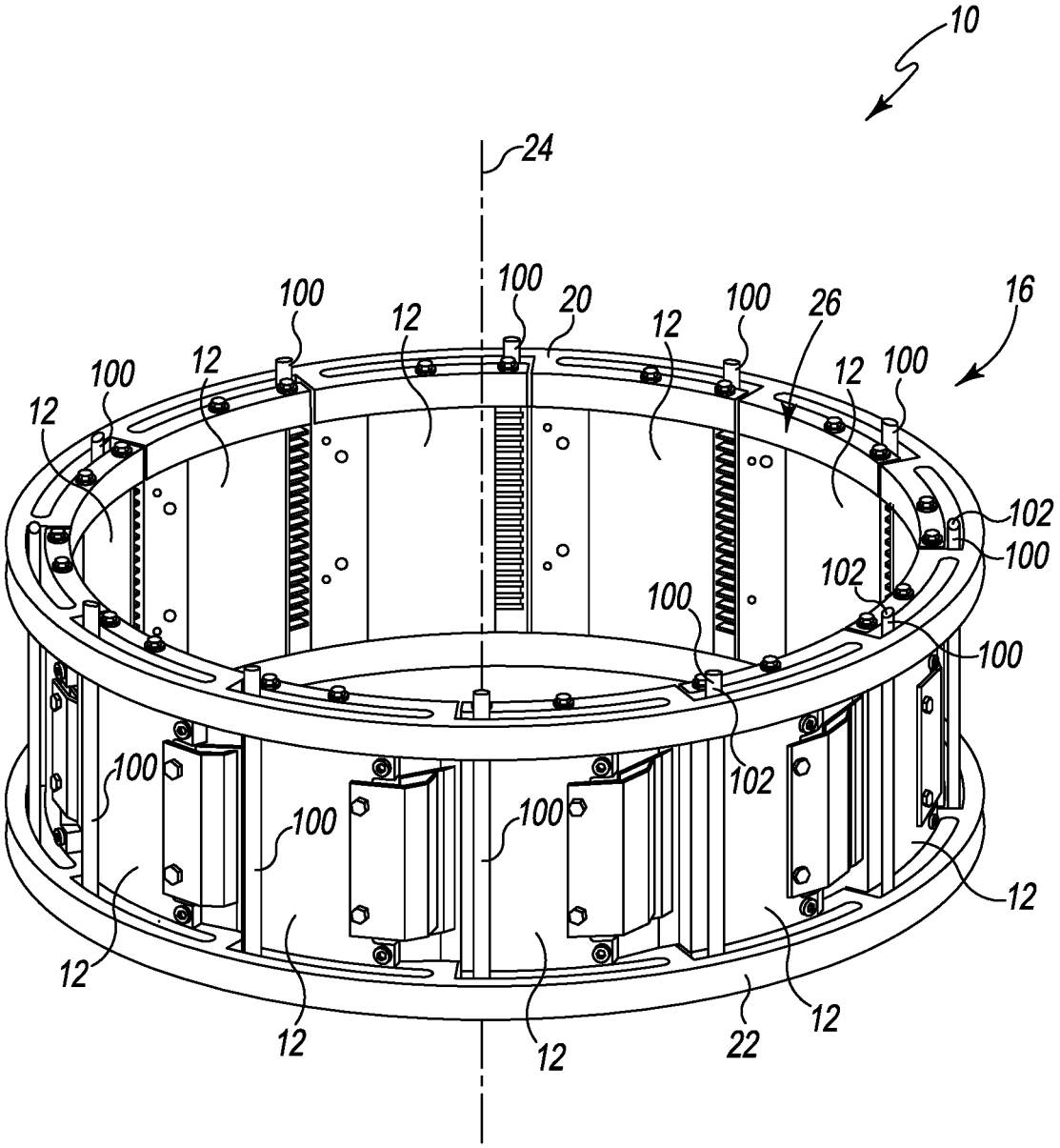
FIG. 1 is a perspective view of a cutting head of an apparatus for cutting food products.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, a cutting head 10 for an apparatus for cutting food products includes a plurality of cutting tools 12 configured to cut food products into slices or strips. The cutting head 10 is configured to be mounted coaxially with an impeller 14 (see FIGS. 7-8) that rotates relative to the cutting head 10 to direct food products into engagement with the cutting tools 12, as described in greater detail below. In the illustrative embodiment, the cutting head 10 includes a plurality of adjustment mechanisms 16, which may be operated to change the positions of the cutting tools 12 and thereby change the thicknesses of the food slices produced by the cutting head 10.

The cutting head 10 includes an upper mounting frame 20 and a lower mounting frame 22 that is spaced apart from the upper mounting frame 20 along a longitudinal or central axis 24 of the cutting head 10. The cutting tools 12 are arranged around the central axis 24 and positioned between the frames 20, 22. The frames 20, 22 and the cutting tools 12 cooperate to define a central cavity 26 in which the impeller 14 is positioned.

Figure 2:
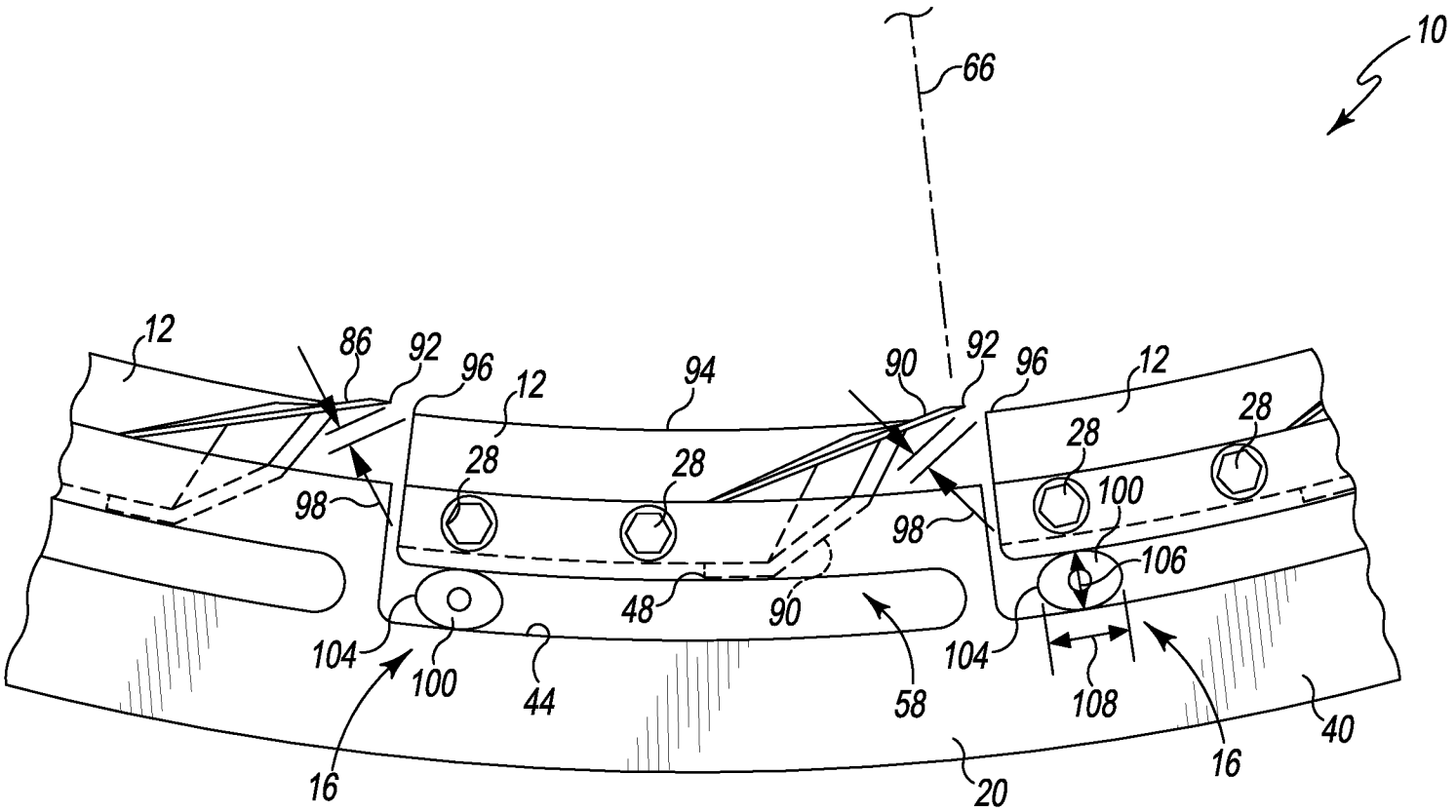
FIG. 2 is a top plan view of a section of the cutting head of FIG. 1.

As shown in FIG. 2, each cutting tool 12 is secured to the frames 20, 22 via a number of fasteners 28. Each fastener 28 is illustratively a bolt 28, which extends through each cutting tool 12 and the frames 20, 22. It should be appreciated that in other embodiments the cutting tools may be secured to the frames via other means such as, for example, welding or the frictional retainer.

Each of the frames 20, 22 is a single integral component formed from a metallic material such as, for example, stainless steel. It should be appreciated that in other embodiments one or both of the frames 20, 22 may be formed as separate components that are later assembled to form each frame. Additionally, the components of each frame may be formed from different materials, including other metallic materials or polymers. In the illustrative embodiment, the configuration of the lower mounting frame 22 is identical to the configuration of the upper mounting frame 20 such that only the configuration of the upper mounting ring is described in greater detail.

Figure 3:
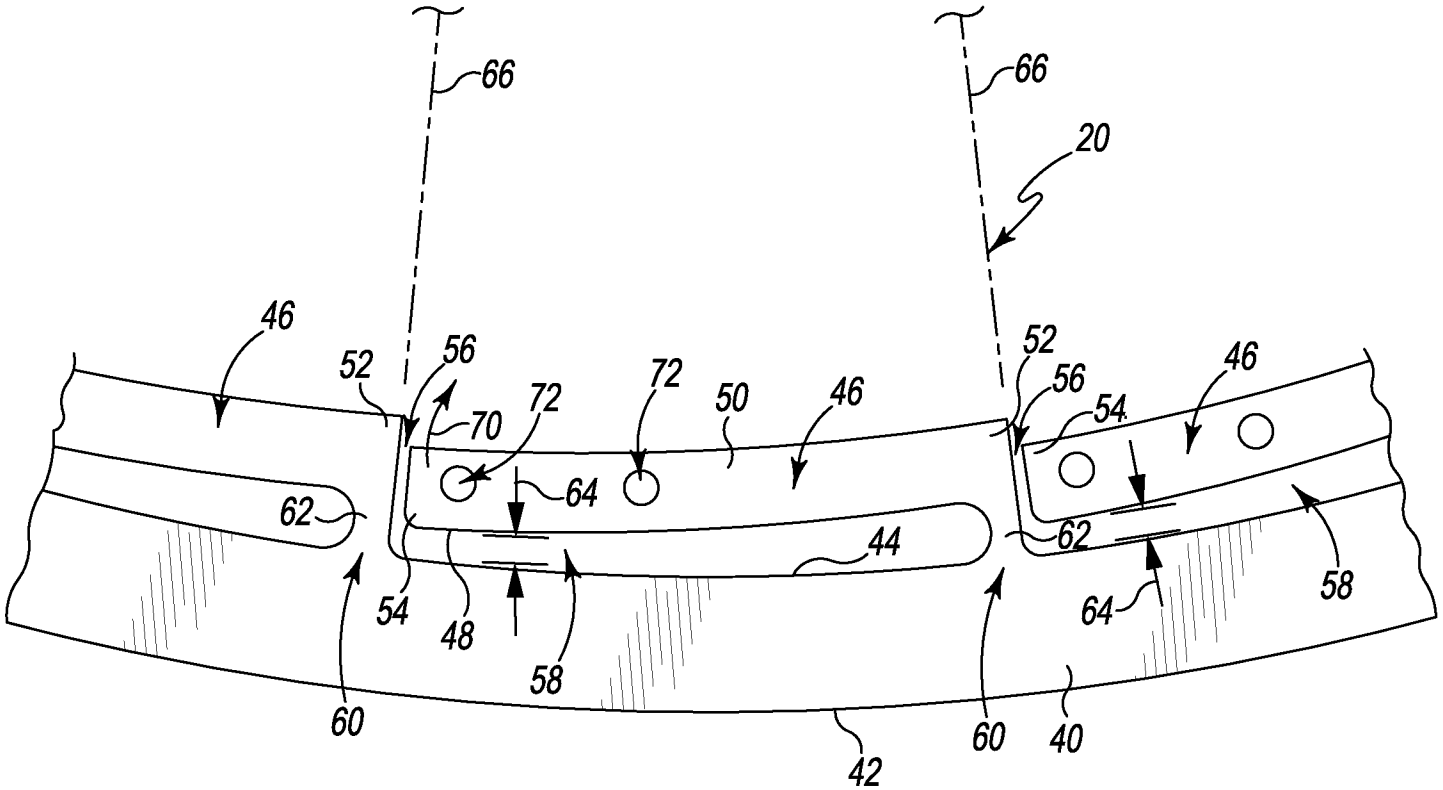
FIG. 3 is a view similar to FIG. 2 showing a section of a mounting ring of the cutting head of FIG. 1.

Referring now to FIG. 3, the frame 20 includes an annular outer ring 40 that extends around the central axis 24. The outer ring 40 has an outer wall 42 that defines the outer circumference of the frame 20 and an inner wall 44 that faces the central axis 24. The frame 20 also includes a plurality of mounting arms 46 that are arranged around the central axis 24 and positioned radially inward (i.e., closer to the central axis 24) of the inner wall 44. Each mounting arm 46 is configured to be secured to one of the ends of a cutting tool 12, as described in greater detail below.

Each mounting arm 46 includes an elongated body 50 that extends from a forward end 52 to a rear tip 54. The rear tip 54 of each mounting arm 46 is spaced apart from the forward end 52 of the next adjacent mounting arm 46 such that a slot 56 is defined between each end 52 and each tip 54. Each elongated body 50 includes an outer wall 48 that is spaced apart from the inner wall 44 of the outer ring 40 such that a channel 58 is defined between each body 50 and the inner wall 44. Each slot 56 opens into one of the channel 58, as shown in FIG. 3.

In the illustrative embodiment, the frame 20 also includes an integral hinge 60 that connects the forward end 52 of each arm 46 to the inner wall 44 of the outer ring 40. The integral hinges 60 are positioned at each end of each channel 58 such that an L-shaped opening is defined between the inner wall 44 and each pair of mounting arms 46. Each integral hinge 60 is configured to permit the rear tip 54 of its corresponding mounting arm 46 (and hence cutting tool 12) to rotate or pivot relative to the outer ring 40. It should be appreciated that in other embodiments one or more of the mounting arms may be connected to the outer ring via other types of joints using pins, keys, or other fasteners to couple each arm 46 to the outer ring 40.

Each integral hinge 60 includes a beam 62 that extends from the inner wall 44 of the outer ring 40 to the forward end 52 of each arm 46. In the illustrative embodiment, the beam 62 is the joint that rotateably couples each cutting tool 12 to outer ring 40. The beam 62 is sized and shaped to deflect resiliently when the rear tip 54 of its corresponding mounting arm 46 is pivoted or rotated in the direction indicated by arrow 70 in FIG. 3. Each mounting arm 46 and each beam 62 are shown in their resting positions in FIG. 3, and a distance 64 is defined between each rear tip 54 and the inner wall 44 of the outer ring 40. Each beam 62 is located on an imaginary radial line 66 extending from the central axis 24.

When each beam 62 is deflected from its resting position, it exerts a force in the direction opposite the arrow 70 to resist further deflection. In that way, the beam 62 is a biasing element that biases each mounting arm 46 toward the position shown in FIG. 3. As used herein, the term "biasing element" refers to resilient or elastic structures or devices that exert an opposing force when compressed, stretched, or otherwise deflected from their resting positions. In addition to the beam 62, other biasing elements include mechanical springs and elastomeric plugs or bodies. Although the frames 20, 22 include only two biasing elements (i.e., upper and lower beams 62) for each mounting arm 46, it should be appreciated that in other embodiments the cutting head 10 may include additional or fewer biasing elements for each mounting arm 46 (and hence each cutting tool 12). It should also be appreciated that in other embodiments additional combinations of biasing elements may be included.

As described above, each mounting arm 46 is configured to be secured to one of the ends of a cutting tool 12. In the illustrative embodiment, each mounting arm 46 includes a number of bores 72 that correspond to, and are sized to receive, the number of bolts 28 that secure each cutting tool 12 to the upper and lower frames 20, 22. Each bore 72 extends through the elongated body 50 of each mounting arm 46 parallel to the central axis 24 of the cutting head 10. It should be appreciated that in other embodiments each mounting arm may have additional or fewer bores depending on the number and nature of the fasteners used to secure the cutting heads to the mounting arms.

Figure 4:
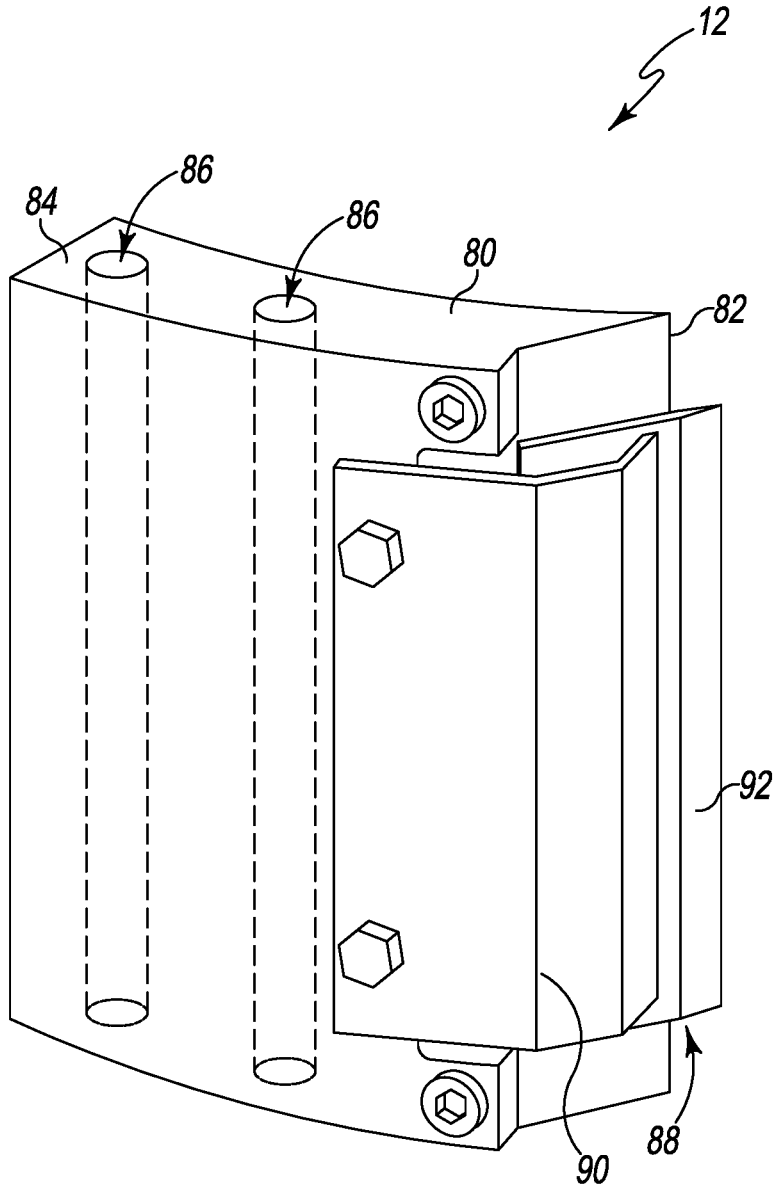
FIG. 4 is a perspective view of a cutting tool of the cutting head of FIG. 1.

Referring now to FIG. 4, one of the cutting tools 12 is shown. In the illustrative embodiment, the configuration of each cutting tool is identical such that only a single cutting tool is described in greater detail. Each cutting tool 12 includes a base 80 that extends from a longitudinal end 82 of the tool 12 to an opposite longitudinal end 84. The base 80 also has a number of bores 86 that are sized to receive the bolts 28 and extend through the base 80 parallel to the central axis 24 of the cutting head 10. Each bore 86 is positioned to align with a corresponding bore 72 of the upper and lower frames 20, 22.

Each cutting tool 12 also includes a knife or cutting blade 88 that is secured to the base 80 at the longitudinal end 82. A clamp 90 secures the cutting blade 88 to the base 80. The cutting blade 88 extends outwardly from the base 80 to a cutting edge 92, which is configured to cut food products that are advanced into engagement with the cutting blade 88 by the impeller 14.

Returning to FIG. 2, the cutting edge 92 of the cutting blade 88 is positioned adjacent to an inner wall 94 of the base 80, on the imaginary radial line 66 extending through the beam 62. It should be appreciated that in other embodiments the cutting edge 92 may be offset from the radial line 66 or located at other positions relative to the mounting frames 20, 22. In the illustrative embodiment, the inner wall 94 is a concave curved wall that extends from the longitudinal end 82 to the other longitudinal end 84. The inner wall 94 also includes a trailing surface 96 that is positioned at the end 84. As described in greater detail below, the trailing surface 96 of one cutting tool 12 cooperates with the cutting edge 92 of the next adjacent cutting tool 12 to form a cutting gap 98 that defines the thickness of the slices produced between those cutting tools. The cutting head 10 includes a plurality of adjustment mechanisms 16 that are operable to move the cutting tools 12 to adjust the size of the cutting gap 98.

In the illustrative embodiment, each adjustment mechanism 16 includes a moveable stop in the form of an elongated shaft 100, which is positioned in the channels 58 of the upper and lower mounting frames 20, 22. As shown in FIG. 1, each shaft 100 has an end 102 positioned above the upper mounting frame 20 and extends downwardly from the end 102 parallel to the central axis 24 through the upper and lower mounting frames 20, 22. As shown in FIGS. 1-2, each shaft 100 has an oblong outer surface 104 that engages the inner wall 44 of each outer ring 40 and the outer walls 48 of the corresponding mounting arms 46 of the upper and lower mounting frames 20, 22.

The oblong outer surface 104 of each shaft 100 is oval-shaped and has a minor diameter 106 and a major diameter 108. The minor diameter 106 is sized to be greater than the distance 64 defined between each mounting arm 46 and the outer ring 40 when the mounting arm 46 is at its resting position. In that way, the shafts 100 are configured to pre-load the beams 62 of the integral hinges 60 by moving the mounting arms 46 (and hence their cutting tools) away from their resting positions to the cutting position shown in FIG. 2 and FIG. 5. In that cutting position, the oblong outer surface 104 engages each mounting arm 46 and the outer ring 40 along its minor diameter 106 and the corresponding beam 62 exerts a biasing force in the direction indicated by arrow 110 in FIGS. 5-6. Each shaft 100 is configured to be separately rotated about its axis to the cutting position shown in FIG. 6, with the oblong outer surface 104 of each shaft 100 acting as a cam to move the mounting arm 46 relative to the outer ring. In the cutting position of FIG. 6, the oblong outer surface 104 engages each mounting arm 46 and the outer ring 40 along its major diameter 108 and the corresponding beam 62 exerts a stronger biasing force in the direction indicated by arrow 110.

Figure 5:
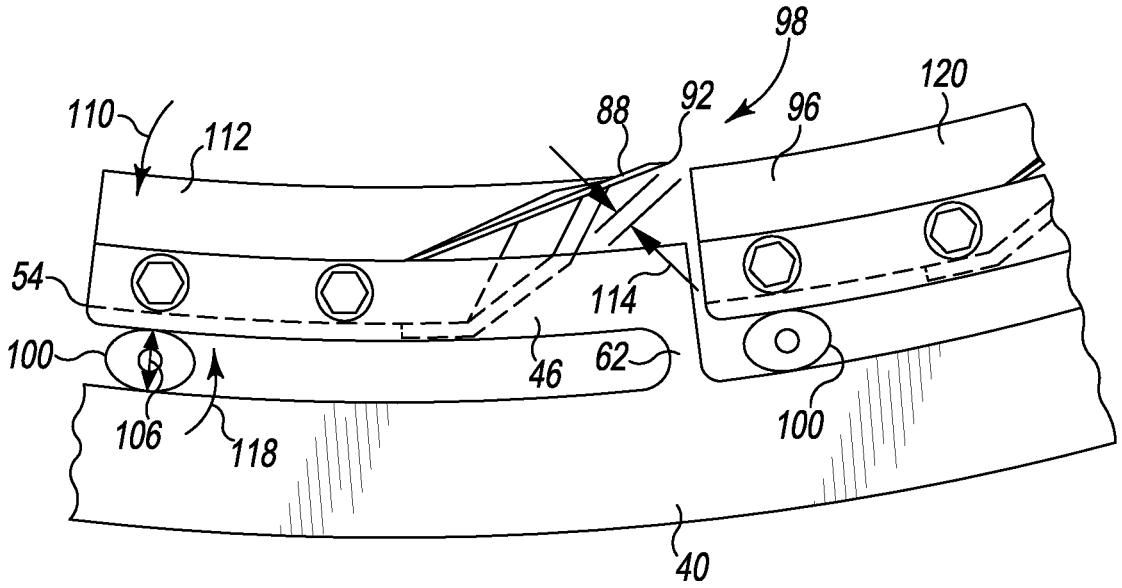
FIG. 5 is a top plan view of a section of the cutting head of FIG. 1 showing a cutting tool placed at one cutting position.
Figure 6:
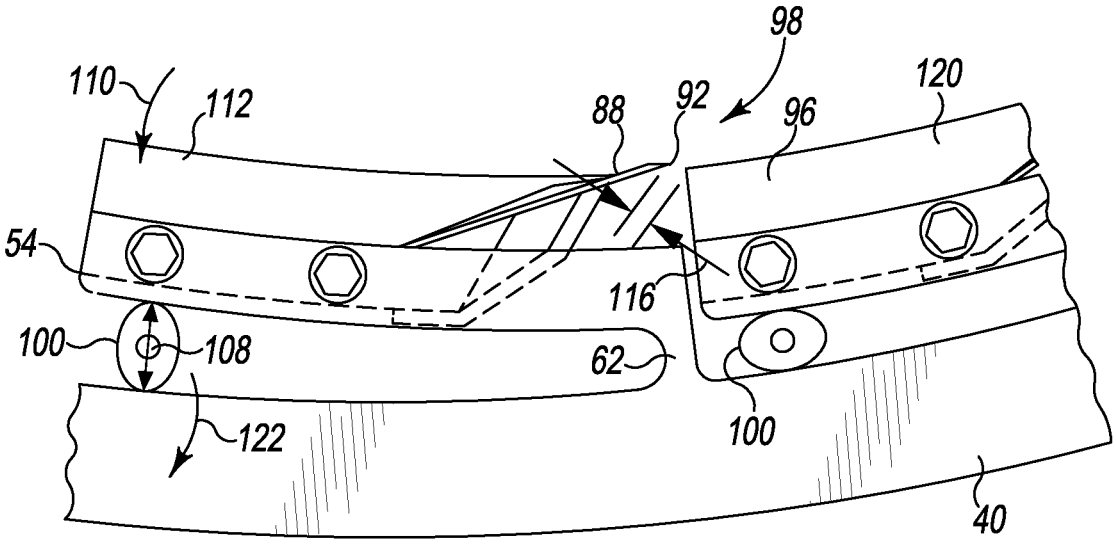
FIG. 6 is a view similar to FIG. 5 showing the cutting tool placed at another cutting position.

As shown in FIGS. 5-6, each shaft 100 is configured to be independently operated to separately adjust each cutting gap 98. For example, when one of the cutting tools (cutting tool 112 in FIGS. 5-6) is in the cutting position shown in FIG. 5, the cutting gap 98 has a thickness 114, which affects the thickness of the resulting food product slice. When the cutting tool 112 is placed in the cutting position shown in FIG. 6, the cutting gap 98 has a smaller thickness 116, which will result in a food product slice of smaller thickness during operation. To move the cutting tool 112 between the position shown in FIG. 5 and the position shown in FIG. 6, a user may grasp the shaft 100 that engages the cutting tool 112 and rotate the shaft 100 in the direction indicated by arrow 118. As the shaft 100 is rotated and the oblong outer surface 104 transitions from the minor diameter 106 to the major diameter 108, the rear tip 54 of the mounting arm 46 is moved toward the central axis 24 of the cutting head 10 and away from the outer ring 40. The cutting edge 92 of the cutting blade 88 of the cutting tool 112 is advanced toward the trailing surface 96 of the adjacent cutting tool (cutting tool 120 in FIGS. 5-6) to narrow the cutting gap 98.

It should be appreciated that the shaft 100 may be rotated to any angular position between the two positions shown in FIGS. 5-6 such that the cutting tool 112 may be placed at any number of cutting positions to permit the creation of food product slices having a variety of different cutting thicknesses. At each cutting position, the beam 62 connecting the cutting tool 112 to the outer ring 40 exerts a biasing force in the direction indicated by arrow 110 to bias the mounting arm 46 into engagement with the elongated shaft 100. When the shaft 100 is rotated in the direction indicated by arrow 122 in FIG. 6, the biasing force exerted by the beam 62 urges the rear tip 54 toward the inner wall 44 of the outer ring 40, thereby causing the cutting edge 92 of the cutting blade 88 to move away from the trailing surface 96 of the cutting tool 120 and widening the cutting gap 98.

The components of the cutting tools are formed separately and assembled as shown in FIGS. 1-6. In the illustrative embodiment, each cutting blade is formed from a metallic material, such as, for example, stainless steel. Each elongated shaft 100 is formed from a metallic material such as, for example, stainless steel. In other embodiments, the shafts may be formed from, for example, a polymeric material.

Figure 7:
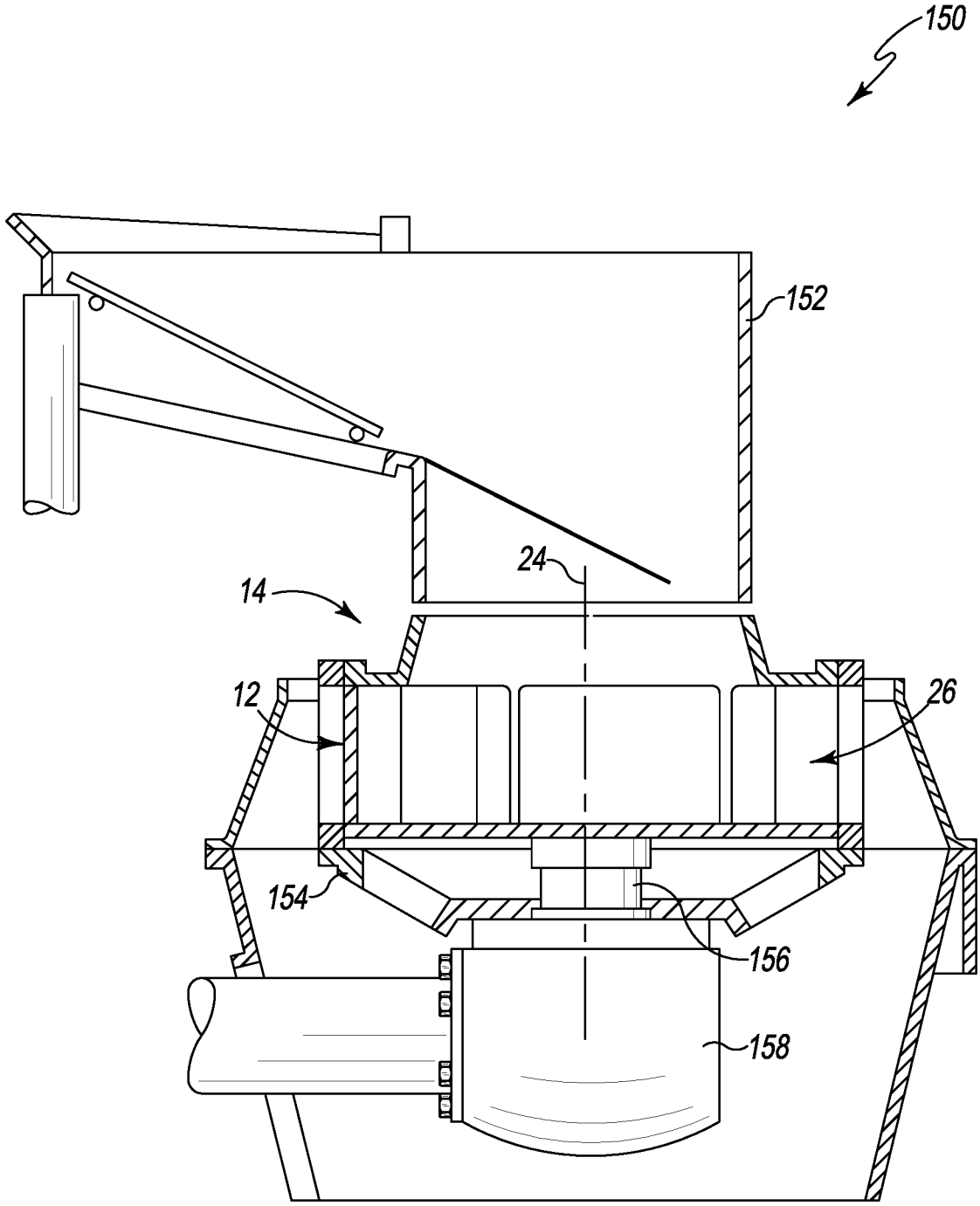
FIG. 7 is a cross-sectional view of an apparatus for cutting food products including the cutting head of FIG. 1.

Referring now to FIG. 7, the cutting head 10 is included in an apparatus 150 for cutting food products into slices or strips. The apparatus 150 is illustratively a centrifugal slicer including an impeller 14 that is positioned in the cavity 26 of the cutting head 10. The slicer 150 also includes a feed hopper 152 that is positioned above the cavity 26 of the cutting head 10. The feed hopper 152 is sized to receive food products and direct them downward into the cavity 26 and into contact with the impeller 14.

The cutting head 10 is secured to a frame 154 of the slicer 150 and is stationary. The impeller 14 is configured to rotate relative to the cutting head 10 about the axis 24. As shown in FIG. 7, the impeller 14 is mounted on a driveshaft 156 that is connected to a gearbox 158. The gearbox is connected to a motor (not shown). The motor, gearbox, and driveshaft are operable to rotate the impeller 14. It should be appreciated that in other embodiments the slicer 150 may include additional components to rotate the impeller.

Figure 8:
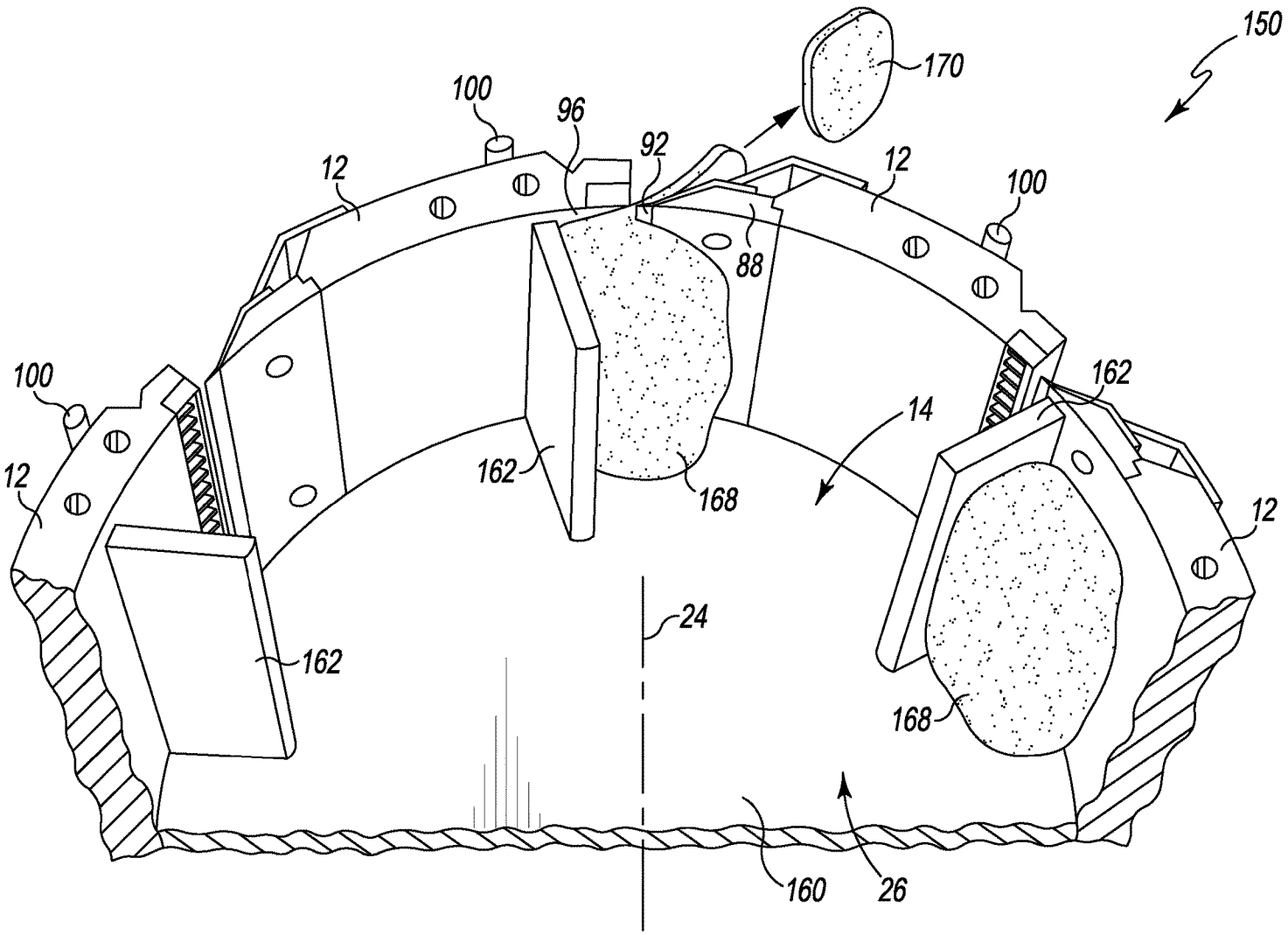
FIG. 8 is a partial cross-sectional perspective view of the cutting head and the apparatus of FIG. 7.

As shown in FIG. 8, the impeller 14 includes a plate 160 and a plurality of paddles 162 that extend upwardly from the plate 160. Each of the paddles 162 is arranged around the central axis 24 and extends radially outward toward the cutting head 10. Each paddle 162 is positioned to direct food products into engagement with the cutting tools 12 of the cutting head 10, which are arranged along the outer periphery of the plate 160.

In use, food products 168 are advanced through the feed hopper 152 into the cavity 26 while the impeller 14 is rotating. The rotation of the impeller 14 pushes the food products 168 into contact with the paddles 162 and centrifugal force causes the food products 168 to advance radially outward into contact with the cutting tools 12. As shown in FIG. 8, the cutting blades 88 of the cutting tools 12 trim each food product 168 between the cutting edge 92 of one cutting tool 12 and the trailing surface 96 of the adjacent cutting tool 12 and the removed portion (e.g., the slice 170) of the food product 168 advance through the cutting gap 98 to be collected in the apparatus 150 for further processing. As described above, a user may operate the adjustment mechanism 16 of each cutting tool 12 to adjust the size of each cutting gap 98 by rotating each shaft 100 to vary the position of the cutting blade 88. The position of the shafts 100 permits the user to operate any of the adjustment mechanisms 16 while operating the apparatus 150.

Figure 9:
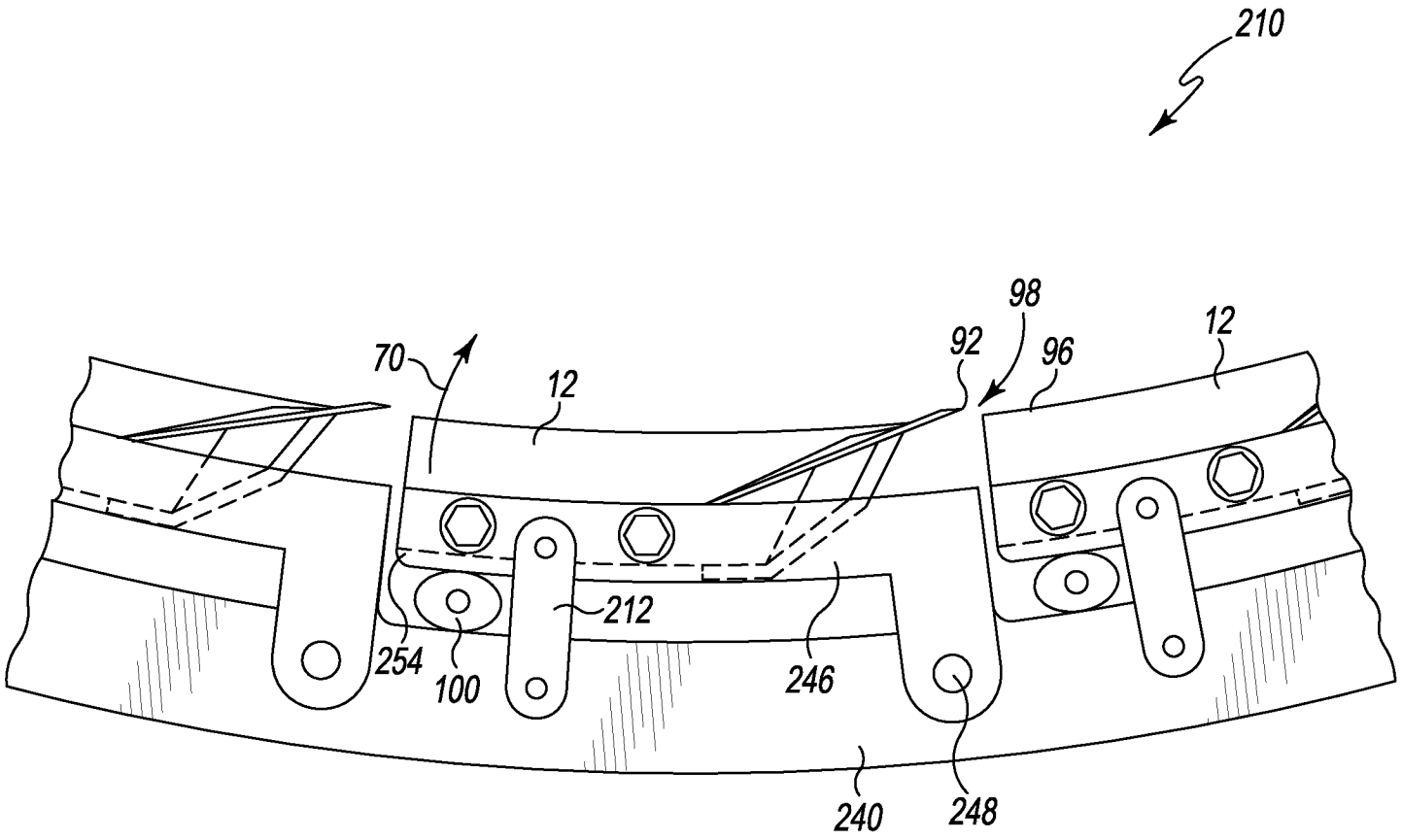
FIG. 9 is a top plan view of a section of another embodiment of a cutting head.

As described above, the cutting head may include different biasing elements configured to preload each cutting tool in for example, as shown in FIG. 9, a cutting head 210 includes a spring, which is illustratively an elastic strap 212 that extends between an outer ring 240 and a mounting arm 246. The mounting arm 246 is pivotally coupled to the outer ring 240 via a pivot pin 248 that extends through the mounting arm 246 and the outer ring 240. The elastic strap 212, like the beam 62 described above in regard to the cutting head 10, is sized and shaped to stretch resiliently when the rear tip 254 of the mounting arm 246 is pivoted or rotated about the pin 248 in the direction indicated by arrow 70 in FIG. 9. In that way, the strap 212 exerts a biasing force in the opposite direction to bias the mounting arm 246 into engagement with the elongated shaft 100.

Figure 10:
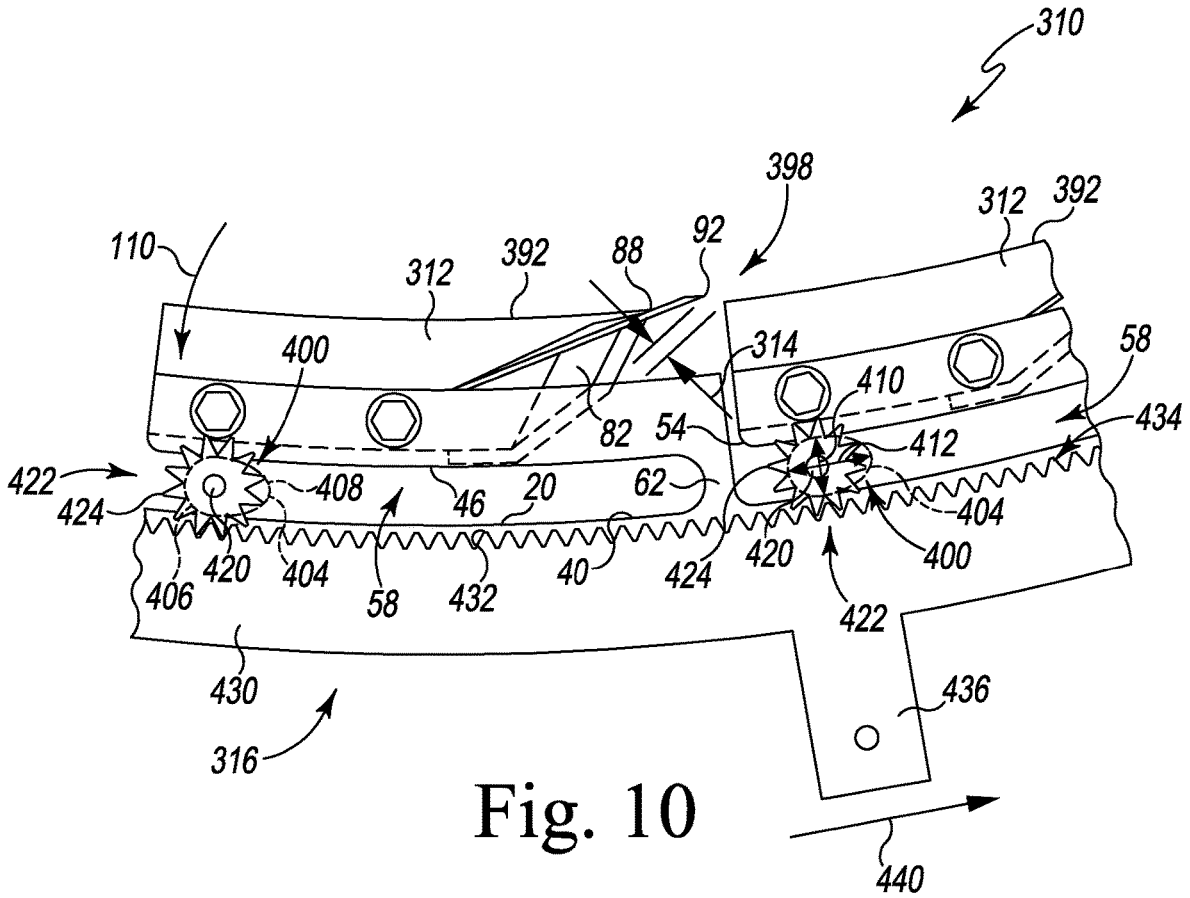
FIG. 10 is a top plan view of a section of another embodiment of a cutting head showing a cutting tool placed at one cutting position.
Figure 11:
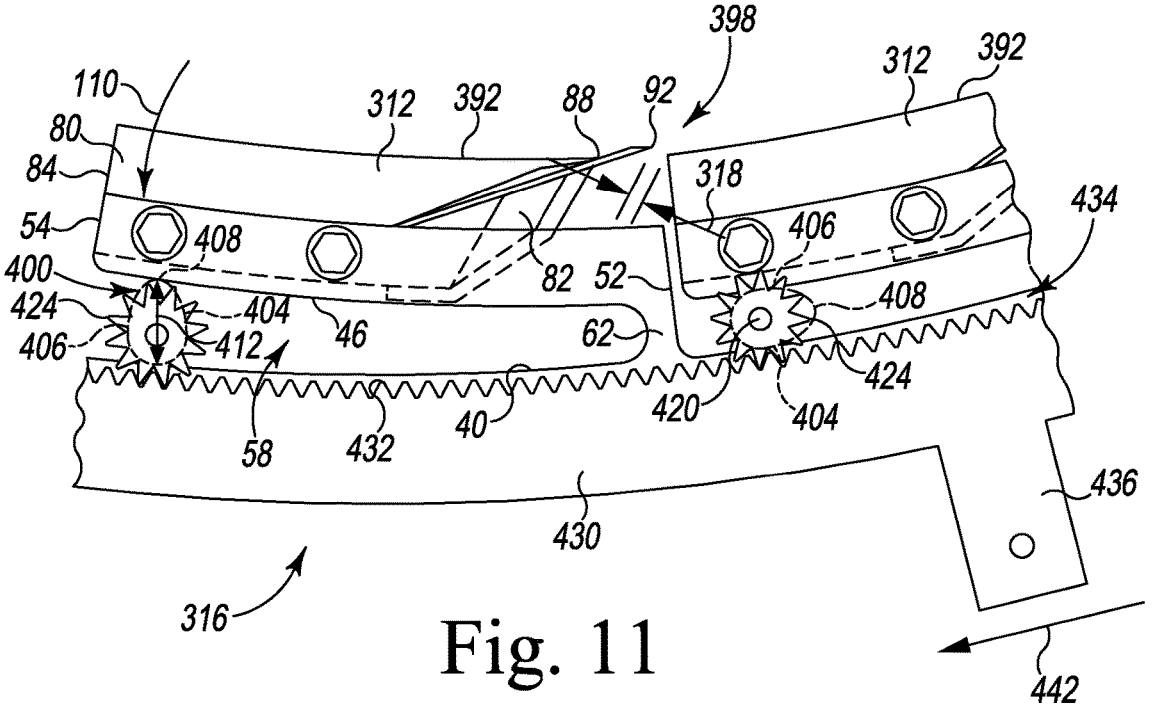
FIG. 11 is a view similar to FIG. 10 showing the cutting tool placed at another cutting position.

Referring now to FIGS. 10-11, a portion of another embodiment of a cutting head (hereinafter the cutting head 310) is shown. Some of the structures of the cutting head 310 are similar to the structures described above in regard to the cutting head 10. Those structures are identified with the same reference numbers in FIGS. 10-11. The cutting head 310 includes a plurality of cutting tools 312 and an adjustment mechanism 316, which may be operated to change the positions of all of the cutting tools 312 to change the thicknesses of the food slices produced by the cutting head 310.

Similar to the cutting head 10, the cutting head 310 includes an upper mounting frame 20 and a lower mounting frame (not shown) that is spaced apart from the upper mounting frame along a central axis 24. In the illustrative embodiment, the configuration of the lower mounting frame of the cutting head 310 is identical to the configuration of the upper mounting frame 20.

Each cutting tool 312 includes a base 80 that extends from a longitudinal end 82 of the tool 312 to an opposite longitudinal end 84. Each cutting tool 312 also includes a knife or cutting blade 88 that is secured to the base 80 at the longitudinal end 82. The cutting blade 88 has a cutting edge 92 that is configured to cut food products that are advanced into engagement with the cutting blade 88 by the impeller 14.

The cutting edge 92 of the cutting blade 88 is positioned adjacent to an inner wall of the base 80. In the illustrative embodiment, the inner wall 94 includes a concave curved surface 392 that extends from the longitudinal end 82 to the edge 84. As shown in FIGS. 10-11, the concave curved surface 392 of one cutting tool 312 cooperates with the cutting edge 92 of the next adjacent cutting tool 312 to form a cutting gap 398 that defines the thickness of the slices produced between those cutting tools.

In the illustrative embodiment, the cutting head 310 includes an adjustment mechanism 316 that is operable to move the cutting tools 312 to adjust the size of the cutting gap 398. The adjustment mechanism 316 includes a plurality of moveable stops in the form of the elongated shafts 400, which are positioned in the channels 58 of the upper and lower mounting frames. As shown in FIGS. 10-11, each shaft 400 has an oblong outer surface 404 that engages the inner wall 44 of the outer ring 40 and the outer walls 48 of its corresponding mounting arms 46 of the upper and lower mounting frame. Each elongated shaft is formed from a metallic material such as, for example, stainless steel. Each shaft 400 has a longitudinal axis that extends parallel to the central axis 24 and is configured to rotate about its longitudinal axis.

The oblong outer surface 404 of each shaft 400 includes a semi-circular section 408 and a semi-elliptical section 406 that cooperate to define a minor diameter 410 and a major diameter 412. The minor diameter 410 is sized to be greater than the distance 64 defined between each mounting arm 46 and the outer ring 40 when the mounting arm 46 is at its resting position. In that way, the shafts 400 are configured to pre-load the beams 62 of the integral hinges 60 by moving the mounting arms 46 (and hence their cutting tools) away from their resting positions to the cutting position shown in FIG. 10. In that cutting position, the oblong outer surface 404 engages each mounting arm 46 and the outer ring 40 along its minor diameter 410 (i.e., the semi-circular section 408) and the corresponding beam 62 exerts a biasing force in the direction indicated by arrow 110 in FIGS. 10-11. As described in greater detail below, the adjustment mechanism 316 is operable to rotate the shafts 400 about their respective axes to the cutting position shown in FIG. 11, with the oblong outer surfaces 404 acting as cams to move the mounting arms 46 relative to the outer ring 40. In this cutting position, the oblong outer surface 404 engages each mounting arm 46 and the outer ring 40 along its major diameter 412 and the corresponding beam 62 exerts a stronger biasing force in the direction indicated by arrow 110.

As shown in FIGS. 10-11, each shaft 400 is configured to be independently operated to separately adjust each cutting gap 398. For example, when one of the cutting tools (cutting tool 312 in FIGS. 10-11) is in the cutting position shown in FIG. 10, the cutting gap 398 has a thickness 314, which affects the thickness of the resulting food product slice. Further, when one of the cutting tools (cutting tool 312 in FIGS. 10-11) is in the cutting position shown in FIG. 11, the cutting gap 398 has a thickness 318, which affects the thickness of the resulting food product slice.

As shown in FIGS. 10-11, each shaft 400 has a pin 420 that extends outwardly from the upper mounting frame 20. It should be appreciated that each shaft may have a corresponding pin extending from the lower mounting frame. The adjustment mechanism 316 includes a gear 422 that is coupled to each pin 420. Each gear 422 is secured to its corresponding pin 420 such that the gears 422 and the shafts 400 rotate together. Each gear 422 includes a plurality of teeth 424 that are formed around the gear's outer circumference. Each gear is illustratively formed from a metallic material such as, for example, stainless steel.

The adjustment mechanism 316 also includes an outer ring 430 that extends around the central axis 24 of the cutting head 310. The outer ring 430 is also formed from a metallic material such as, for example, stainless steel in this embodiment. The outer ring 430 is moveably coupled to the upper mounting frame 20 and configured to rotate about a rotation axis that is coincident with the central axis 24. The outer ring 430 has an inner wall 432 and a plurality of teeth 434 that are defined in the inner wall 432. As shown in FIGS. 10-11, the teeth 434 of the ring 430 are interdigitated with the teeth 424 of the gears 422. When the outer ring 430 is rotated relative to the upper mounting frame 20, the engagement between the teeth 424, 434 causes the gears 422 (and hence the shafts 400) to rotate between cutting positions. In the illustrative embodiment, the adjustment mechanism 316 also includes a handle 436 that extends from the outer ring 430. The handle 436 may be used to rotate outer ring 430 in the directions indicated by arrows 440, 442 and thereby operate the adjustment mechanism 316 to move all of the cutting tools 312 between cutting positions. It should be appreciated that the handle may be attached to an automated mechanism to permit automatic adjustment of all of the cutting tools 312.

It should be appreciated that the cutting head may include other adjustment mechanisms operable to change the positions of the cutting tools. For example, the outer rings may include one or more sloped inner surfaces that engage the trailing ends of each mounting arm to cause the cutting tools to rotate or pivot. In other embodiments, the cutting head may include a lever arm that is connected at one end of each cam and at the opposite end to a corresponding mounting arm. A pivot point on the lever arm may be located such that larger movements of the cam and/or outer ring may deliver smaller movements to mounting arm(s), thereby providing a fine adjustment mechanism to drive higher resolution changes in the gap size. One embodiment of such a design is shown in FIGS. 12-13.

Figure 12:
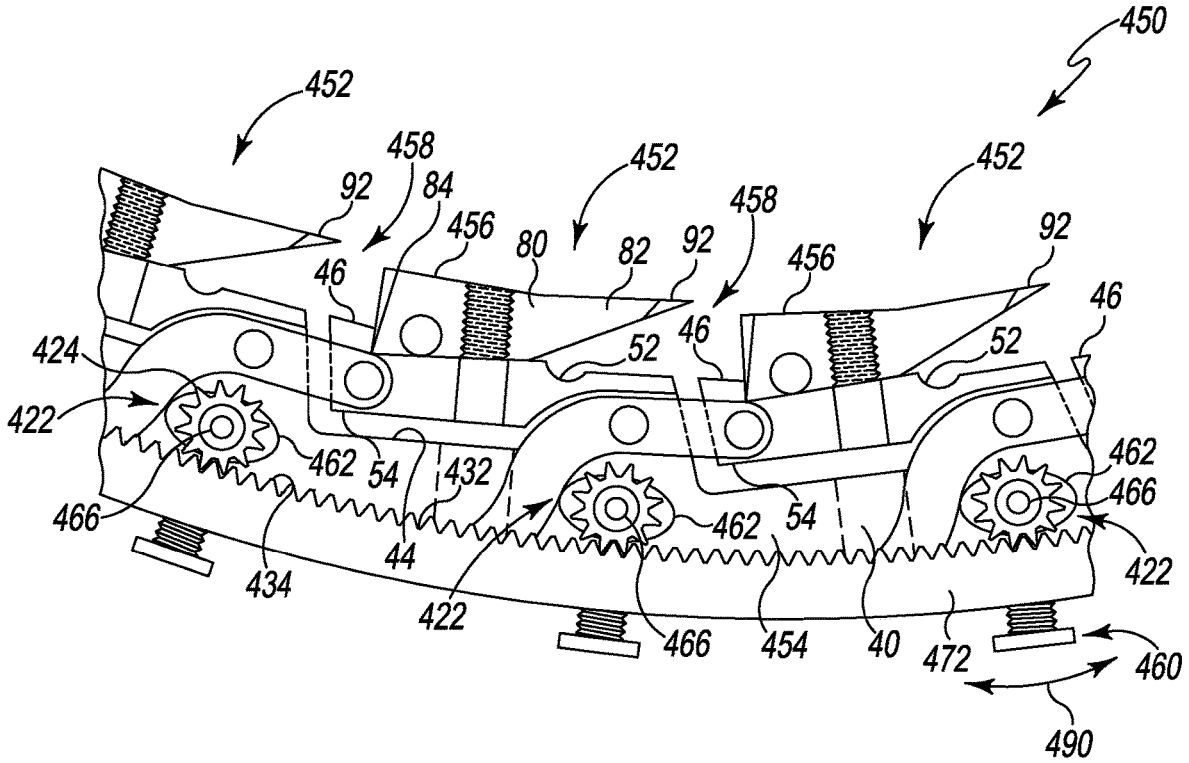
FIG. 12 is a top plan view of a section of another embodiment of a cutting head showing a cutting tool placed at one cutting position.
Figure 13:
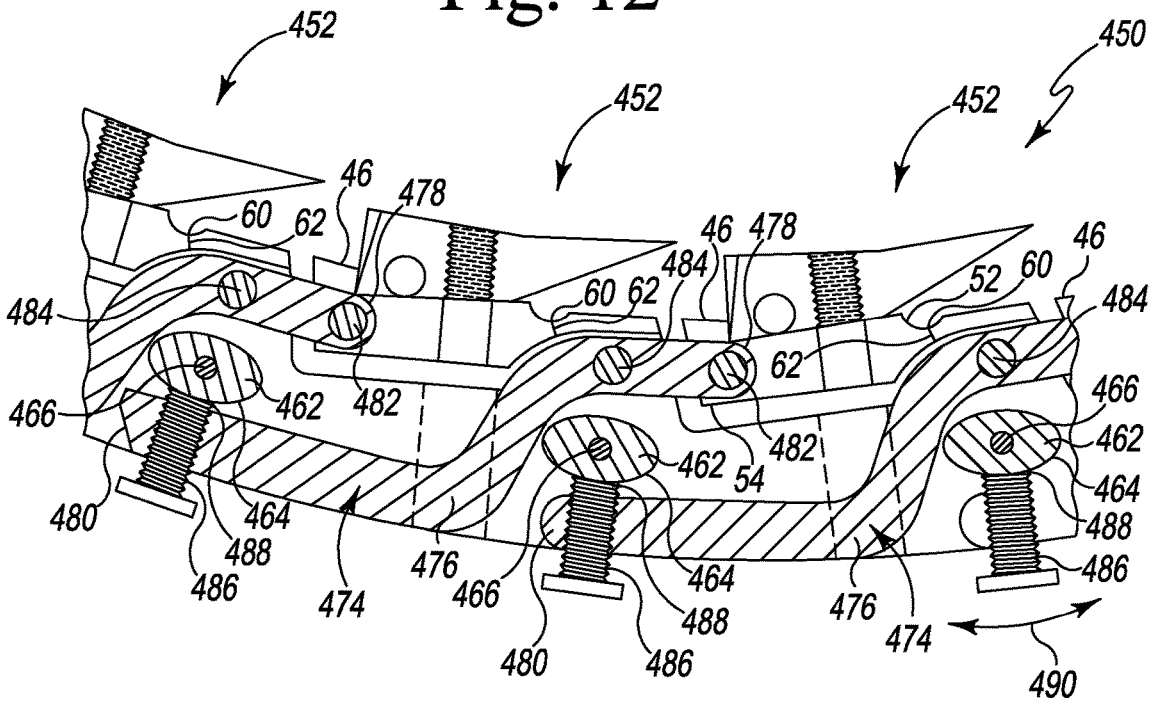
FIG. 13 is a partial cross-section plan view of the embodiment of FIG. 12.

Referring now to FIGS. 12-13, a portion of another embodiment of a cutting head (hereinafter the cutting head 450) is shown. Some of the structures of the cutting head 450 are similar to the structures described above in regard to the cutting head 10, 310. Those structures are identified with the same reference numbers in FIGS. 12-13. The cutting head 450 includes a plurality of cutting tools 452 and an adjustment mechanism 460, which may be operated to change the positions of all of the cutting tools 452 to change the thicknesses of the food slices produced by the cutting head 450.

Similar to the cutting heads 10, 310, the cutting head 450 includes an upper mounting frame (not shown) and a lower mounting frame 454 that is spaced apart from the upper mounting frame along a central axis 24 of the cutting head 450. In the illustrative embodiment, the configuration of the upper mounting frame of the cutting head 450 is identical to the configuration of the lower mounting frame 454.

Similar to the cutting tools described above, each cutting tool 452 includes a base 80 that extends from a longitudinal end 82 of the tool 452 to an opposite longitudinal end 84. Each cutting tool 452 also includes a knife or cutting blade 88 that is secured to the base 80 at the longitudinal end 82. The cutting blade 88 has a cutting edge 92 that is configured to cut food products that are advanced into engagement with the cutting blade 88 by the impeller 14 and a trailing surface 456 positioned at the end 84. The trailing surface 456 of one cutting tool 452 cooperates with the cutting edge 92 of the next adjacent cutting tool 452 to form a cutting gap 458 that defines the thickness of the slices produced between those cutting tools.

Each of the mounting frames includes an annular outer ring 40 that extends around the central axis 24. Each outer ring 40 has an inner wall 44 that faces the central axis 24. A plurality of mounting arms 46 are arranged around the central axis 24 and positioned radially inward (i.e., closer to the central axis 24) of the inner wall 44. Each mounting arm 46 is configured to be secured to one of the ends of a cutting tool 452, as shown in FIGS. 12-13. Each mounting arm includes a forward end 52 connected to the outer ring 40 and a rear tip 54.

In the illustrative embodiment, each frame 20 also includes an integral hinge 60 that connects the forward end 52 of each arm 46 to the outer ring 40. Each integral hinge 60 is configured to permit the rear tip 54 of its corresponding mounting arm 46 (and hence cutting tool 12) to rotate or pivot relative to the outer ring 40. It should be appreciated that in other embodiments one or more of the mounting arms may be connected to the outer ring via other types of joints using pins, keys, or other fasteners to couple each arm 46 to the outer ring 40.

As shown in FIG. 13, each integral hinge 60 includes a beam 62 that extends from the outer ring 40 to the forward end 52 of each arm 46. In the illustrative embodiment, the beam is the joint that rotateably couples each cutting tool 12 to outer ring 40. The beam is sized and shaped to deflect resiliently when the rear tip 54 of its corresponding mounting arm 46 is pivoted or rotated. As with the other embodiments, it should be appreciated that structures other than the integral hinges may be used to bias the mounting arms in position and/or resist deflection of the mounting arms.

As described above, the cutting head 450 includes an adjustment mechanism 460 that is operable to move the cutting tools 452 to adjust the size of the cutting gap 458. It should be appreciated that, like the embodiment of FIGS. 10-11, the cutting head 450 may include separate adjustment mechanisms operable to separately adjust the size of the cutting gap 458 defined between a single pair of cutting tools 452 or groups of cutting tools 452 that include less than all of the cutting tools 452.

The adjustment mechanism 460 includes a plurality of elongated shafts 462, which are positioned between the upper and lower mounting frames. As shown in FIG. 13, each shaft 462 has an oblong outer surface 464 similar to the elongated shafts 100. Each elongated shaft is formed from a metallic material such as, for example, stainless steel. Each shaft 462 has a longitudinal axis that extends parallel to the central axis 24 and is configured to rotate about its longitudinal axis.

As shown in FIGS. 12-13, each shaft 462 has a pin 466, and a gear 468 is coupled to each pin 466. Each gear 422 is secured to its corresponding pin 466 such that the gears 422 and the shafts 462 rotate together. Each gear 422 includes a plurality of teeth 424 that are formed around the gear's outer circumference. Each gear is illustratively formed from a metallic material such as, for example, stainless steel.

The adjustment mechanism 460 also includes an outer ring 472 that extends around the central axis 24 of the cutting head 450. The outer ring 472 is also formed from a metallic material such as, for example, stainless steel in this embodiment. The outer ring 472 is moveably coupled to the mounting frames and configured to rotate about a rotation axis that is coincident with the central axis 24. The outer ring 472 has an inner wall 432 and a plurality of teeth 434 that are defined in the inner wall 432. As shown in FIGS. 12-13, the teeth 434 of the ring 472 are interdigitated with the teeth 424 of the gears 422.

When the outer ring 472 is rotated relative to the mounting frames, the engagement between the teeth 424 causes the gears 422 (and hence the shafts 462) to rotate between cutting positions. In the illustrative embodiment, the adjustment mechanism 460 also includes a handle (not shown) that extends from the outer ring 472. The handle may be used to rotate outer ring 472 to operate the adjustment mechanism 460 and thereby move all of the cutting tools 452 between cutting positions. It should be appreciated that the handle may be attached to an automated mechanism to permit automatic adjustment of all of the cutting tools 452.

The adjustment mechanism 460 also includes a plurality of pivot handles 474 that are pivotally coupled to the mounting frames. Each pivot handle 474 includes a body 476 that extends from a forward end 478 coupled to a rear tip 54 of one of the mounting arms 46 to a rear end 480 positioned adjacent to one of the elongated shafts 462. Each pivot handle is illustratively formed from a metallic material such as, for example, stainless steel. As shown in FIG. 13, an elongated pin 482 extends through the forward end 478 of each pivot handle 474 and the rear tip 54 of the corresponding mounting arm 46 to pivotally couple the pivot handle 474 to the corresponding mounting arm 46.

The adjustment mechanism 460 also includes an elongated pin 484 that extends through the body 476 of each pivot handle 474 and into the outer rings 40 of the upper and lower mounting frames. In that way, the pins 484 pivotally couple the pivot handles 474 to the mounting frames. In the illustrative embodiment, the pin 484 is connected to each handle body 476 between the forward end 478 and the rear end 480 of the pivot handle.

In the illustrative embodiment, the adjustment mechanism 460 includes a threaded shaft 486 that is coupled each pivot handle 474. Each thread shaft 486 has a tip 488 that engages the oblong outer surface 464 of the elongated shaft 462, and each tip 488 is positioned adjacent to the corresponding pivot handle 474. As shown in FIG. 13, each threaded shaft 486 is attached to the rear end 480 of the pivot handle and may be rotated relative to the pivot handle to adjust the position of the shaft tip 488. When rotated, the tip 488 of the threaded shaft 486 may be moved away from the pivot handle 474 to thereby move the end 480 of that pivot handle away from the elongated shaft 462. As described in greater detail below, the movement of the pivot handle end adjusts the size of one of the cutting gaps 458 of the cutting head 450. In that way, the combination of the pivot handles, elongated shafts, and threaded shafts form a plurality of moveable stops for the cutting head 450.

In use, the outer ring 472 of the adjustment mechanism 460 may be rotated in either direction indicated by arrows 490. When rotated, the engagement between the teeth 424, 434 causes the gears 422 (and hence the shafts 462) to rotate, thereby bringing different sections of the oblong outer surface 464 of each shaft 462 in contact with the threaded shaft 486 of the corresponding pivot handle 474. With the oblong outer surface 464 of each shaft 462 acting as a cam engaged with the shaft 486, each pivot handle 474 is rotated about its elongated pin 482 relative to the mounting frames, thereby changing the radial position of the forward end 478 of each pivot handle 474. As the forward ends 478 of the pivot handles 474 change position, the rear tips 56 of mounting arms 46 and cutting edges of the cutting tools change their radial positions to change the sizes of the cutting gaps 458. The oblong surfaces and ability to change the position of each threaded shaft permits fine adjustments of each cutting gap size. It should be appreciated that the hinges 60 are configured to resist any deflection or movement of the mounting arms 46 away from the resting position of the hinges 60 shown in FIGS. 12-13.

There are a plurality of advantages of the present disclosure arising from the various features of the processes, apparatuses, and systems described herein. It will be noted that alternative embodiments of the processes, apparatuses, and systems of the present disclosure may not include all of the features described yet still benefit from at least some of the advantages of such features. Those of ordinary skill in the art may readily devise their own implementations that incorporate one or more of the features of the present invention and fall within the spirit and scope of the present disclosure as defined by the appended claims.

The invention claimed is:

1. An apparatus for cutting food products, the apparatus comprising:

a cutting head comprising a plurality of cutting tools arranged around a central axis, each cutting tool including a cutting blade positioned at a first end and a trailing surface positioned at a second end opposite the first end, wherein the trailing surface of a first cutting tool of the plurality of cutting tools cooperates with the cutting blade of a second cutting tool of the plurality of cutting tools to define a cutting gap, wherein the first cutting tool is rotatable between a first position in which the cutting gap is a first cutting thickness and a second position in which the cutting gap is a second cutting thickness that is different from the first cutting thickness, wherein the cutting head includes a biasing element that biases the first cutting tool toward the first position, and wherein the cutting head includes an adjustment mechanism operable to rotate the first cutting tool between the first position and the second position.

2. The apparatus of claim 1, wherein the second cutting thickness is less than the first cutting thickness such that the cutting head is configured to produce slices of the food products that are thinner when the first cutting tool is positioned at the second position than when the first cutting tool is positioned at the first position.

3. The apparatus of claim 2, wherein the trailing surface of the first cutting tool is located (i) a first radial distance from the central axis when the first cutting tool is positioned at the first position and (ii) a second radial distance from the central axis when the first cutting tool is positioned at the second position, the second radial distance being different from the first radial distance.

4. The apparatus of claim 1, further comprising an annular ring extending around the central axis, wherein the biasing element is a spring having a first end that engages the annular ring and a second end that engages the second end of the first cutting tool.

5. The apparatus of claim 4, wherein the spring is an elastic strap extending between the annular ring and the first cutting tool.

6. The apparatus of claim 1, further comprising an annular ring extending around the central axis, each cutting tool of the plurality of cutting tools being rotateably coupled to the annular ring.

7. The apparatus of claim 6, wherein the biasing element includes an integral hinge that couples the first cutting tool to the annular ring.

8. The apparatus of claim 6, wherein:

the first cutting tool further includes a base extending from the first end of the first cutting tool to the second end of the first cutting tool, the base being rotateably coupled to the annular ring at a first joint that is located on an imaginary radial line extending from the central axis, and the cutting blade of the first cutting tool includes a leading edge that is located on the imaginary radial line.

9. The apparatus of claim 8, wherein the leading edge of the cutting blade is spaced radially inward from the first joint.

10. The apparatus of claim 8, wherein the first joint includes an integral hinge that connects the base to the annular ring.

11. The apparatus of claim 1, wherein the adjustment mechanism includes a cam that is rotatable about a cam axis between a first rotation position in which the first cutting tool is located at the first position and a second rotation position in which the first cutting tool is located at the second position.

12. The apparatus of claim 11, wherein the cam engages the second end of the first cutting tool.

13. The apparatus of claim 11, wherein the cam includes a curved, oblong outer surface that engages the first cutting tool.

14. The apparatus of claim 13, further comprising an outer ring, and the curved, oblong outer surface engages the outer ring.

15. The apparatus of claim 11, wherein:

the adjustment mechanism further includes (i) a first body coupled to the cam, the first body being configured to rotate and having a first plurality of gear teeth, and (ii) a second body coupled to the first body, the second body being configured to rotate and having a second plurality of gear teeth interdigitated with the first plurality of gear teeth, and rotation of the second body causes rotation of the first body and rotation of the cam between the first rotation position and the second rotation position.

16. The apparatus of claim 15, wherein the second body is configured to rotate about a rotation axis that extends parallel to the central axis.

17. The apparatus of claim 16, wherein the adjustment mechanism includes:

a cam engaged with each of the plurality of cutting tools, each cam being rotatable about a cam axis to cause the rotation of a corresponding cutting tool of the plurality of cutting tools, and a first body is coupled to each cam and the second body, wherein rotation of the second body causes rotation of each first body and rotation of each cam to cause the rotation of each cutting tool of the plurality of cutting tools.

18. The apparatus of claim 15, wherein the second body is configured to rotate about a rotation axis that extends coincident with the central axis.

19. The apparatus of claim 11, wherein the cam axis extends parallel to the central axis.

20. The apparatus of claim 1, further comprising:

a plate operable to rotate about the central axis, wherein the cutting head is positioned at an outer periphery of the plate and cooperates with the plate to define a chamber sized to receive one or more food products.

21. The apparatus of claim 1, wherein:

each of the plurality of cutting tools is operable to rotate relative to the other cutting tools, and the adjustment mechanism includes an annular body rotateably coupled to the plurality of cutting tools, and rotation of the annular body causes rotation of each of the plurality of cutting tools.

22. The apparatus of claim 1, wherein the adjustment mechanism includes a moveable stop coupled to the first cutting tool.

23. An apparatus for cutting food products, the apparatus comprising:

a cutting head comprising a plurality of cutting tools arranged around a central axis, each cutting tool including a cutting blade positioned at a first end and a trailing surface positioned at a second end opposite the first end, wherein the trailing surface of a first cutting tool of the plurality of cutting tools cooperates with the cutting blade of a second cutting tool of the plurality of cutting tools to define a cutting gap, wherein the trailing surface of the first cutting tool is rotatable between a first position in which the cutting gap is a first cutting thickness and a second position in which the cutting gap is a second cutting thickness that is different from the first cutting thickness, wherein the cutting head includes a biasing element that biases the first cutting tool toward the first position, and wherein the cutting head includes an adjustment mechanism coupled to the first cutting tool, the adjustment mechanism including a moveable stop operable to rotate the first cutting tool between the first position and the second position.

24. The apparatus of claim 23, wherein the moveable stop engages the second end of the first cutting tool.

25. The apparatus of claim 23, wherein the moveable stop includes a curved, oblong outer surface that engages the first cutting tool.

26. The apparatus of claim 25, comprising an outer ring, and the curved, oblong outer surface engages the outer ring.

27. The apparatus of claim 23, wherein:

the adjustment mechanism further includes (i) a first body coupled to the moveable stop, the first body being configured to rotate and having a first plurality of gear teeth, and (ii) a second body coupled to the first body, the second body being configured to rotate and having a second plurality of gear teeth interdigitated with the first plurality of gear teeth, and rotation of the second body causes rotation of the first body to operate the moveable stop to rotate the first cutting tool between the first position and the second position.

28. The apparatus of claim 27, wherein:

the moveable stop is one of a plurality of moveable stops, each moveable stop being operable to cause the rotation of a corresponding cutting tool of the plurality of cutting tools, the first body is one of a plurality of first bodies, each first body being coupled to a corresponding moveable stop and the second body, and rotation of the second body causes rotation of each first body to operate the moveable stops to cause the rotation of the plurality of cutting tools.

29. An apparatus for cutting food products, the apparatus comprising:

a cutting head comprising a plurality of cutting tools arranged around a central axis, each cutting tool including a cutting blade positioned at a first end and a second end positioned opposite the first end, wherein the second end of each cutting tool cooperates with the cutting blade of an adjacent cutting tool to define a cutting gap, wherein each cutting tool is rotatable between a first position in which the cutting gap is a first cutting thickness and a second position in which the cutting gap is a second cutting thickness that is different from the first cutting thickness, and wherein the cutting head includes an adjustment mechanism operable to rotate multiple cutting tools of the plurality of cutting tools between the first position and the second position.

30. The apparatus of claim 29, wherein the cutting head includes a plurality of biasing elements, each biasing element configured to bias a corresponding cutting tool in the first position.

31. The apparatus of claim 30, wherein the plurality of biasing elements include an elastic strap.

32. The apparatus of claim 31, wherein the plurality of biasing elements include an integral hinge.

33. The apparatus of claim 29, wherein the adjustment mechanism is operable to rotate all of the cutting tools of the plurality of cutting tools together.

34. The apparatus of claim 33, wherein the adjustment mechanism includes:

a plurality of moveable stops, each moveable stop being operable to cause the rotation of a corresponding cutting tool of the plurality of cutting tools, a plurality of first bodies, each first body having a first plurality of gear teeth and coupled to a corresponding moveable stop to rotate with the corresponding moveable stops, a second body coupled to the plurality of first bodies, the second body being configured to rotate and having a second plurality of gear teeth interdigitated with the first plurality of gear teeth of each first body, and rotation of the second body causes rotation of the first body to operate the moveable stops to rotate the cutting tools between their respective first position and second position.

35. The apparatus of claim 34, wherein the plurality of moveable stops include a plurality of cams.

36. The apparatus of claim 29, further comprising a plurality of biasing elements, each biasing element configured to bias a corresponding cutting tool in the first position.

37. An apparatus for cutting food products, the apparatus comprising:

a cutting head comprising a plurality of cutting tools arranged around a central axis, each cutting tool including a cutting blade positioned at a first end and a trailing surface positioned at a second end opposite the first end, wherein the trailing surface of a first cutting tool of the plurality of cutting tools cooperates with the cutting blade of a second cutting tool of the plurality of cutting tools to define a cutting gap, wherein the trailing surface of the first cutting tool is rotatable between a plurality of positions, the plurality of positions including a first position in which the cutting gap is a first cutting thickness and a second position in which the cutting gap is a second cutting thickness that is different from the first cutting thickness, wherein the cutting head includes a biasing element that biases the first cutting tool in the first position, and wherein the cutting head includes a moveable stop configured to cooperate with the biasing element to maintain the first cutting tool at any of the plurality of positions.

* * * * *